US006742959B2

(12) United States Patent
Strassman

(10) Patent No.: US 6,742,959 B2
(45) **Date of Patent: *Jun. 1, 2004**

(54) ASPHALT HEATER

(75) Inventor: David R. Strassman, Madison, WI (US)

(73) Assignee: DRS Limited, Madison, WI (US)

( * ) Notice: Subject to any disclaimer, the term of this patent is extended or adjusted under 35 U.S.C. 154(b) by 35 days.

This patent is subject to a terminal disclaimer.

(21) Appl. No.: 10/387,626

(22) Filed: Mar. 13, 2003

(65) Prior Publication Data

US 2003/0170075 A1 Sep. 11, 2003

Related U.S. Application Data

(63) Continuation of application No. 09/322,881, filed on May 28, 1999, now Pat. No. 6,551,017.

(60) Provisional application No. 60/087,657, filed on Jun. 2, 1998.

(51) Int. Cl.[7] ..... E01C 23/14

(52) U.S. Cl. ..... 404/95; 404/77; 404/79

(58) Field of Search ..... 404/77, 79, 95

(56) References Cited

U.S. PATENT DOCUMENTS

| | | | | |
|---|---|---|---|---|
| 3,259,122 A | | 7/1966 | Lenker | |
| 3,311,104 A | | 3/1967 | Wollner et al. | |
| 3,565,406 A | * | 2/1971 | Wollner | 432/223 |
| 3,852,025 A | | 12/1974 | Placek | |
| 3,865,098 A | | 2/1975 | Culter | |
| 3,874,801 A | | 4/1975 | White | |
| 4,046,484 A | | 9/1977 | Holz, Sr. et al. | |
| 4,210,217 A | | 7/1980 | Lachowicz | |
| 4,345,779 A | | 8/1982 | Busby | |
| 4,559,922 A | * | 12/1985 | Crupi et al. | 126/271.2 A |
| 4,561,800 A | * | 12/1985 | Hatakenaka et al. | 404/79 |
| 4,682,578 A | * | 7/1987 | Schmidt | 126/91 R |
| 4,749,303 A | | 6/1988 | Keizer et al. | |
| 4,779,889 A | | 10/1988 | Morrison | |
| 4,846,143 A | | 7/1989 | Csadenyi | |
| 4,860,841 A | | 8/1989 | Sacco | |
| 4,946,384 A | * | 8/1990 | London | 431/349 |
| 5,114,284 A | | 5/1992 | Keizer et al. | |
| 5,148,799 A | | 9/1992 | St-Louis et al. | |
| 5,188,481 A | | 2/1993 | O'Brien | |
| 5,218,952 A | | 6/1993 | Neufeldt | |
| 5,246,365 A | | 9/1993 | Himmel et al. | |
| 5,338,047 A | | 8/1994 | Knisley | |
| 5,451,076 A | | 9/1995 | Burkhead | |
| 5,468,143 A | * | 11/1995 | Weber et al. | 431/243 |
| 5,653,552 A | | 8/1997 | Wiley et al. | |
| 5,868,618 A | | 2/1999 | Hiebert | |
| 6,551,017 B1 | * | 4/2003 | Strassman | 404/77 |

FOREIGN PATENT DOCUMENTS

GB 2 223 465 A 4/1990

OTHER PUBLICATIONS

HILGENDORF™ Utility Cart Brochure, CSF Incorporated Automation Plus® Division HILGENDORF™ Cart Division, 94 Catalog No. 2000–1.

* cited by examiner

*Primary Examiner*—Thomas B. Will
*Assistant Examiner*—Raymond W Addie
(74) *Attorney, Agent, or Firm*—Joseph T. Leone, Esq.; DeWitt Ross & Stevens S.C.

(57) ABSTRACT

Disclosed is a trailer which is self-propelled via a powered tongue jack and which optionally includes a light-weight, high-efficiency asphalt heater. The trailer is moved long distances, such as to and from work sites, using a towing vehicle, in conventional fashion. When at the work site (or storage site), the tongue jack is lowered to support the trailer in a generally horizontal position, and, by virtue of a powered jack wheel, can be used to position the trailer easily, quietly, and confidently, in either the forward or reverse direction. The jack is powered by any conventional means, including an ac or dc electric motor or an internal combustion engine. A reversible, variable-speed, dc electric motor powered by a conventional 12 Volt battery supply is preferred.

3 Claims, 5 Drawing Sheets

ASPHALT HEATER

CROSS-REFERENCE TO RELATED APPLICATIONS

This is a Continuation of application Ser. No. 09/322,881 filed May 28, 1999 U.S. Pat. No. 6,551,017, which application claims priority under 35 USC §119(e) to U.S. Provisional Patent Application 60/087,657, filed Jun. 2, 1998, the entirety of which is incorporated herein by reference.

FIELD OF THE INVENTION

The present invention is drawn to a self-propelled trailer for any purpose having a tongue jack which includes a support wheel which is powered by any suitable means. The preferred embodiment of the invention is a trailer which includes means for heating asphalt and a self-propelled tongue jack.

DESCRIPTION OF THE PRIOR ART

The prior art describes several types of devices used in coupling and uncoupling trailers. U.S. Pat. No. 5,451,076 to Burkhead discloses a pneumatic landing gear to raise and lower the feet of a trailer eliminating the need for a hand crank. Here, the gear incorporates the use of a pneumatic actuator which is powered by air from already existing air pressure in the trailer. The gear can be installed during the manufacturer of the trailer or as an add-on to an already existing trailer.

A device to align a trailer to the tow bar of a towing vehicle is described in Knisley, U.S. Pat. No. 5,338,047. The device has a wheeled body for easy rotation and alignment of the trailer tongue.

Morrison, U.S. Pat. No. 4,779,889, discloses a swivel wheel for a trailer. The wheel assembly has a goose-necked shaped axle and is capable of being mounted on a variety of trailer frames. The invention allows for a pivot means for easy movement of the trailer and a locking means to prevent any unwanted pivoting.

A drive mechanism for trailer lifting gear is described in Busby, U.S. Pat. No. 4,345,779. The trailer lifting gear has two telescopic support legs, an air driven rotary drive, and a connecting means. The telescopic support legs are generally wheeled to ease in movement of the trailer. The air driven rotary drive can be connected to a currently existing source of air pressure on the trailer.

United Kingdom Patent No. GB 2 223 465 A to Flounders discloses an articulated vehicle which has a tractor and a trailer. The trailer has a wheeled front end support which can be raised and lowered by a direct current electric motor. The invention is intended to eliminate the use of a hand crank to raise and lower the trailer for attachment and detachment.

The prior art also describes various processes for heating surfaces, including asphalt. A process for continuously heating an asphalt surface is described in Wiley et al., U.S. Pat. No. 5,653,552. The process involves moving at least two independent heaters arranged in a series back and forth along the asphalt surface until the asphalt is heated to the desired temperature. In addition, the process may involve rupturing the heated asphalt to establish a ruptured upper surface. After moisture is eliminated through mixing of the ruptured upper surface, the surface is pressed to provide a recycled asphalt surface.

U.S. Pat. No. 5,218,952 to Neufeldt describes a radiant heating apparatus used to heat a large surface area of asphalt to a desired temperature. The heating apparatus uses a pressurized gaseous fuel, such as propane, to generate heat and has an open bottom, covered with a layer of ceramic fiber between two layers of mesh and an upper chamber.

O'Brien, U.S. Pat. No. 5,188,481, discloses an asphalt heating unit which heats already existing asphalt surfaces. The heating unit rests on a movable frame which allows rotation of the heating unit to several positions. One embodiment of the invention substitutes a trailer for the movable frame. In addition, the heating unit may use various forms of heating sources in its heating chamber, such as an infrared heater.

U.S. Pat. No. 5,114,284 to Keizer et al. is a continuation of U.S. Pat. No. 4,749,303 to Keizer et al. The applications disclose a hinged asphalt heater. The heater has two heating sections with a hinge in the middle. Both sections contain wheels to allow the sections to be moved along the surface to be heated. The outer casing of the first section contains a removable fuel tank and the outer casing of the second section contains a set a trailer tires and a trailer tongue. The hinge allows the sections to be folded together so that the wheels of the second section are touching the ground and the trailer tongue can be attached to a vehicle for the easy movement of the heater. Each section has a mixing channel which receives a combustible fuel mixture for heating the section.

A gas pilot igniter for igniting combustible gases and burning fuel/air mixtures is described in London, U.S. Pat. No. 4,946,384. One advantage of the igniter is its ability to allow the use of fuels with variable combustion points. Here, the igniter includes a fuel gas inlet means, a primary mixing chamber, a main combustion chamber, a pre-combustion chamber and a baffle plate.

U.S. Pat. No. 3,852,025 to Placek discloses an infra-red heater. The heater is gas-fired and has a cup shaped body, an open front end and a mixing area for the combustible air mixture. A combustion screen is used to prevent flashbacks which are common in gas-fired radiant heat generators. In addition, the heater is particularly useful in the removal of paint, the softening of adhesives and the softening of flooring surfaces.

None of the above references, taken alone or in any combination, describe the trailer including self-propelled tongue jack disclosed and claimed herein.

SUMMARY OF THE INVENTION

A major problem encountered when using trailers of any sort is accurately positioning the trailer in the desired location or maneuvering the trailer through an area of restricted access. If the trailer and its contents are sufficiently light, the trailer can be moved manually (literally) or manually with the assistance of a wheeled trailer dolly. However, if the trailer and its load are sufficiently heavy (e.g., a large boat trailer or a trailer used in a semi-tractor/trailer rig), they cannot be moved manually. In most instances, the only means to move the trailer is to use a towing vehicle such as a car, truck, or tractor. As anyone who has tried to back a trailer-borne boat or mobile home into a garage can attest, it is not an easy task to maneuver the towing vehicle in reverse such that the trailer arrives at the desired location. Such efforts are invariably accompanied by much trial and error. In the course of such efforts, it is not uncommon that the trailer is mistakenly collided into surrounding structures or people, causing damage to both the item which was hit and the content being carried on the trailer.

A particular variation of the above-noted problems is encountered when using trailer-borne asphalt heaters. As amply illustrated in the references cited in the Description of the Prior Art, asphalt heaters often include a heating element which can be extremely heavy. For example, if refractory stone is used in the asphalt heating apparatus, it is not uncommon for trailers carrying such heaters to have gross weights exceeding 1,500 kg. However, during any given project, the trailer bearing the asphalt heater must be accurately positioned and repositioned as the job progresses. The large weight of such trailer-borne asphalt heating devices precludes positioning them by hand; a towing vehicle must be used to position the asphalt heater. As noted above, this makes it quite difficult to accurately position the heater without a good deal of trial and error.

The fact that a towing vehicle must be used in asphalt heating operations is doubly troublesome because not only must the asphalt heater be positioned accurately (in an often cluttered setting, such as an existing residential worksite), the task is complicated by the presence of softened asphalt. Due to existing structures, the towing vehicle must often be driven upon newly laid, still-malleable asphalt in order to access certain parts of the worksite. Due to the weight of the trailer, it tends to leave tire tracks in the still-warm asphalt. To eliminate the tracks, the asphalt must be re-heated (if necessary) and re-rolled. The only other alternative is to wait until the section of asphalt which must be traversed is sufficiently hardened and then proceed with the job. In either event, time (and therefore money) is wasted.

The present invention solves both problems by providing a trailer which is self-propelled via a powered tongue jack and which optionally includes a light-weight, high-efficiency asphalt heater. The trailer is moved long distances, such as to and from worksites, using a towing vehicle, in conventional fashion. When at the workplace (or storage site), the tongue jack described herein is lowered to support the trailer in a generally horizontal position, and, by virtue of a powered jack wheel, can be used to position the trailer, easily, quietly, and confidently, in either the forward or reverse direction. The jack is powered by any conventional means, including an ac or dc electric motor or an internal combustion engine. A reversible, variable-speed, dc electric motor powered by a conventional 12 Volt battery supply is preferred.

When using the powered jack, the user generally faces toward the rear of the trailer, in the direction the trailer is traveling. A 360-degree rotatable collar allows the trailer to be accurately positioned and re-positioned without the use of a towing vehicle. When the jack is powered using the preferred dc motor, operation of the jack is extremely quiet as compared to using a towing vehicle or an internal combustion engine.

It is preferred that the motor is controlled using a variable-speed, reversible trigger switch. Such switches are commonly used in hand tools such as power drills and the like. The variable-speed function of the switch and motor allows the trailer to be moved relatively quickly where there is no danger of collision, and then moved continuously slower where greater precision is required. Likewise, because the switch is reversible, the trailer can be moved back and forth to maneuver it into otherwise inaccessible locations.

The jack itself comprises a suitably rigid, essentially vertical member which serves to leverage the trailer into a horizontal position by contact with the ground. A wheel is positioned at the end of the vertical member to make contact with the ground. The wheel may be set on a fixed axle or may be castored to allow easy lateral movement. The vertical member may comprise a series of telescoping poles so that the jack can be raised clear of the ground when the trailer is attached to a towing vehicle. The vertical member itself may also be rotatably mounted to the trailer so that it can be moved from a first, engaged position, supporting the trailer, to a second, disengaged position, where the jack is moved up and away from the ground so as not to interfere with the towing of the trailer.

Another novel aspect of the invention is the combination of a self-propelled jack with a very straightforward, light-weight, and efficient asphalt heater. According to the invention, the asphalt heater comprises a housing which is divided into an upper chamber and a lower chamber by a sheet or board of permeable refractory material suspended within the housing. The lower chamber of the housing is open at its lower end. A fuel-air mixture is supplied to the upper chamber by means of a fuel supply line passing first through a venturi device (to mix the fuel with a proper proportion of air) and then into a supply manifold. The fuel is charged into the upper chamber at a relatively low pressure, preferably 0.10 to 0.50 inches of water ($3.6\times10^{-3}$ to $1.8\times10^{-2}$ pounds per square inch, 2.54 to 12.7 kgs per $m^2$).

The fuel-air mixture diffuses through the refractory material into the lower chamber of the housing, where it is ignited by an ignition sub-assembly. The burning fuel-air mixture creates a partial vacuum in the lower chamber of the housing, thereby encouraging movement of the fuel air mixture into the lower chamber. The refractory material functions to direct the heat of the combustion downward and out of the open end of the lower chamber. In use, the heat is directed against asphalt to soften it for various operations, such as printing of decorative designs and the like.

Further aims, objects, and advantages of the invention will become clear upon a complete reading of the Detailed Description of the Invention and attached drawing figures.

DETAILED DESCRIPTION OF THE INVENTION

Figure 1:
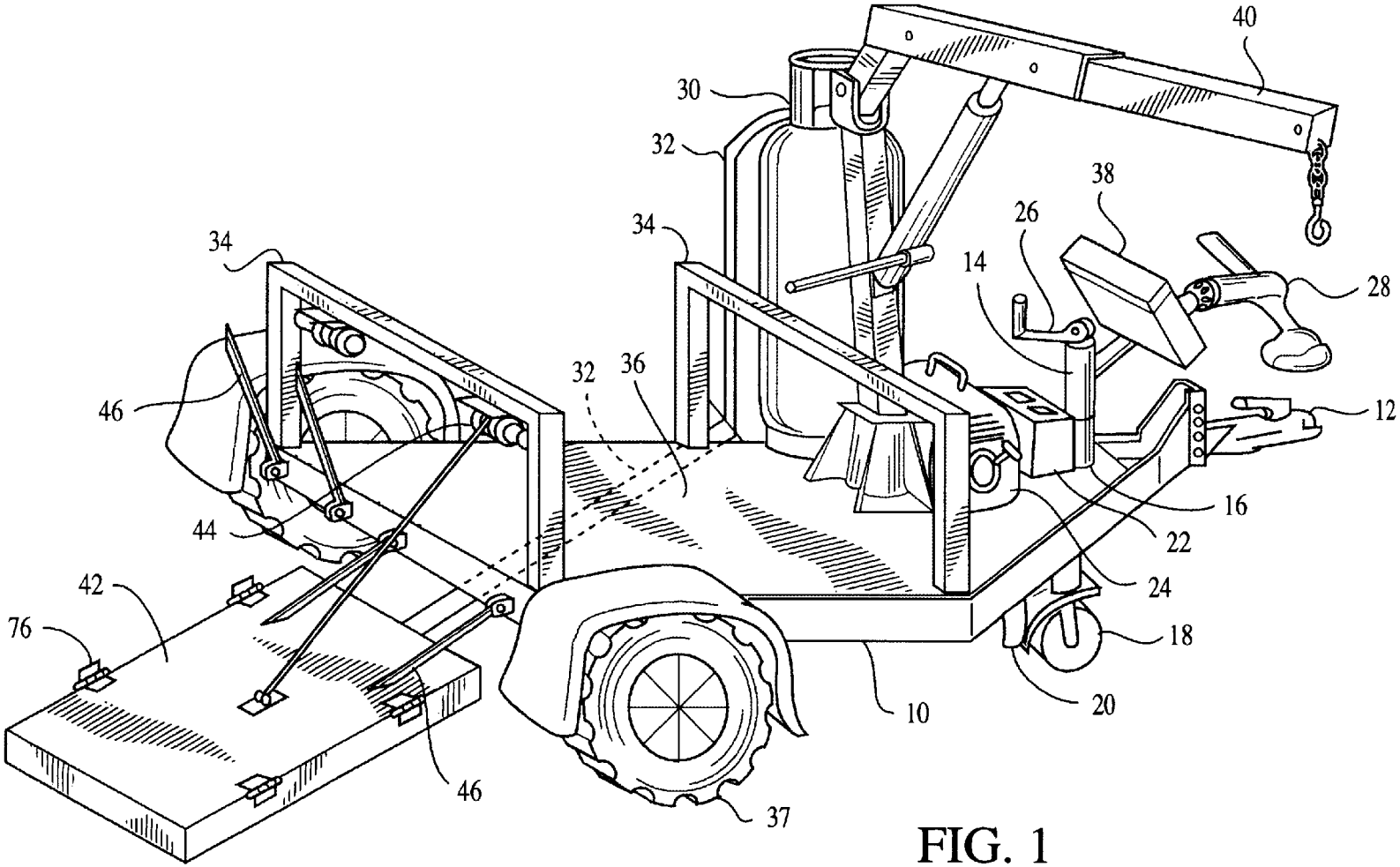
FIG. 1 is a perspective rendering of the preferred embodiment of the invention.

Referring particularly to the drawing figures, FIG. 1 depicts a trailer 10 according to the present invention. The trailer comprises a tongue 12 for releasibly fastening the trailer to a towing vehicle and a storage deck 36 upon which any number of items may be stored for transport to and from a work site. Optional stabilizer frames 34 are depicted in FIG. 1. The stabilizer frames function to add overall structural rigidity to the trailer. When being towed by a vehicle, the trailer rolls upon main wheels 37.

Figure 2:
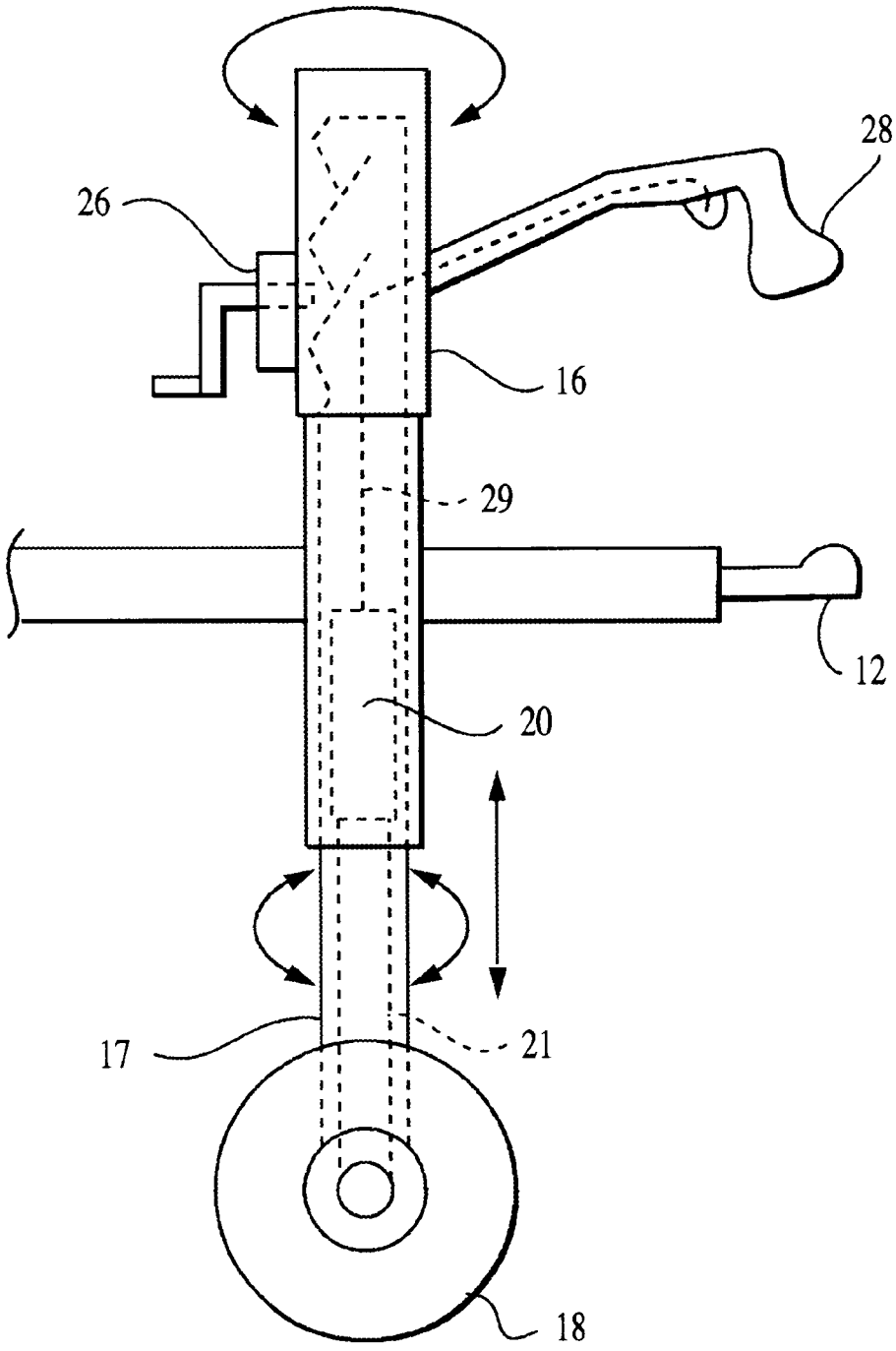
FIG. 2 is a schematic rendering of the powered tongue jack according to the present invention.

As shown in FIGS. 1 and 2, the trailer is supported by a reciprocating, self-propelled tongue jack 14. The jack includes a jack winch 26 at its upper end to raise and lower the jack, and a jack wheel 18 at its lower end for contacting the ground when the jack is supporting the trailer. Rotatable collar 16 allows the wheel 18 to be turned in a 360 degree range of motion perpendicular to the vertical plane of the wheel.

As shown in FIG. 2, the jack may comprise a series of telescoping tubes 17 which allow the jack to be raised and lowered using, for example, the jack winch 26, a shaft, a belt, a chain, or reduction gearing 21. The jack may also be rotatably mounted to the trailer or releasibly mounted to the trailer so that it can be safely distanced from the ground when not in use.

A key element of the jack is that the jack wheel 18 is powered by a motor 20 linked to the wheel by means of a direct linkage or via suitable reduction gearing 21 (see FIG. 2). The motor 20 can be any suitable prime mover, such as an ac or dc electric motor, or an internal combustion engine (gasoline, diesel, etc.). The preferred motor is a 12 Volt, variable-speed, reversible electric motor. As shown in FIG. 1, the motor is powered by battery 22. An optional back-up generator 24 may also be provided to either power the motor directly or to recharge the battery in the event it becomes drained of charge.

As shown in FIG. 1, the motor 20 is situated outside the vertical axis of the jack itself and adjacent to the jack wheel 18. As shown in FIG. 2, the motor 20 is situated within the vertical axis of the jack itself, which tends to create a more compact and streamlined outer appearance. The exact positioning of the motor, however, is irrelevant to the invention, so long as the motor is operationally connected to the wheel 18.

The direction and speed of the motor is controlled by switch 28 which is connected to the motor 20 by electrical lead 29. To take advantage of the preferred motor, it is also preferred that the switch 28 be a variable-speed, reversible switch. For ease of maneuverability, it is even more preferred that the switch be a trigger-type switch (akin to those found on power hand drills) which is incorporated into the rotatable collar 16. In this fashion, the speed of travel, the direction of travel of the trailer itself, and the direction of the motor (forward or reverse), can all be controlled using only one hand.

This combination of a retractable, rotatable, and self-propelled tongue jack, with a trailer of any design, is a vast improvement over prior art devices. By mating the weight of the trailer and the load to be carried with a motor of sufficient power, trailers of great weight can be easily, precisely, and confidently positioned using only one hand. The trigger switch 28 provides a secure and reassuring "hand-shake"-type grip which allows the trailer to be maneuvered either forward or backward with great precision.

The power generated by the motor 20 can be transmitted to the wheel 18 by any means now known or developed in the future. Such means include, but are not limited to, direct linkages, such as by a shaft, or via a belt, chain, or reduction gears.

The trailer itself may also include optional accessories such as a lift boom 40 The lift boom, which can be manual, electric, hydraulic, pneumatic, etc., is used to lift heavy items onto and off of the trailer storage deck 36.

Another aspect of the invention is coupling a trailer with a self-propelled tongue jack as described above to an asphalt heater. According to the invention, the trailer/self-propelled tongue jack described herein can be used in conjunction with any type of asphalt heater, without limitation.

Figure 3:
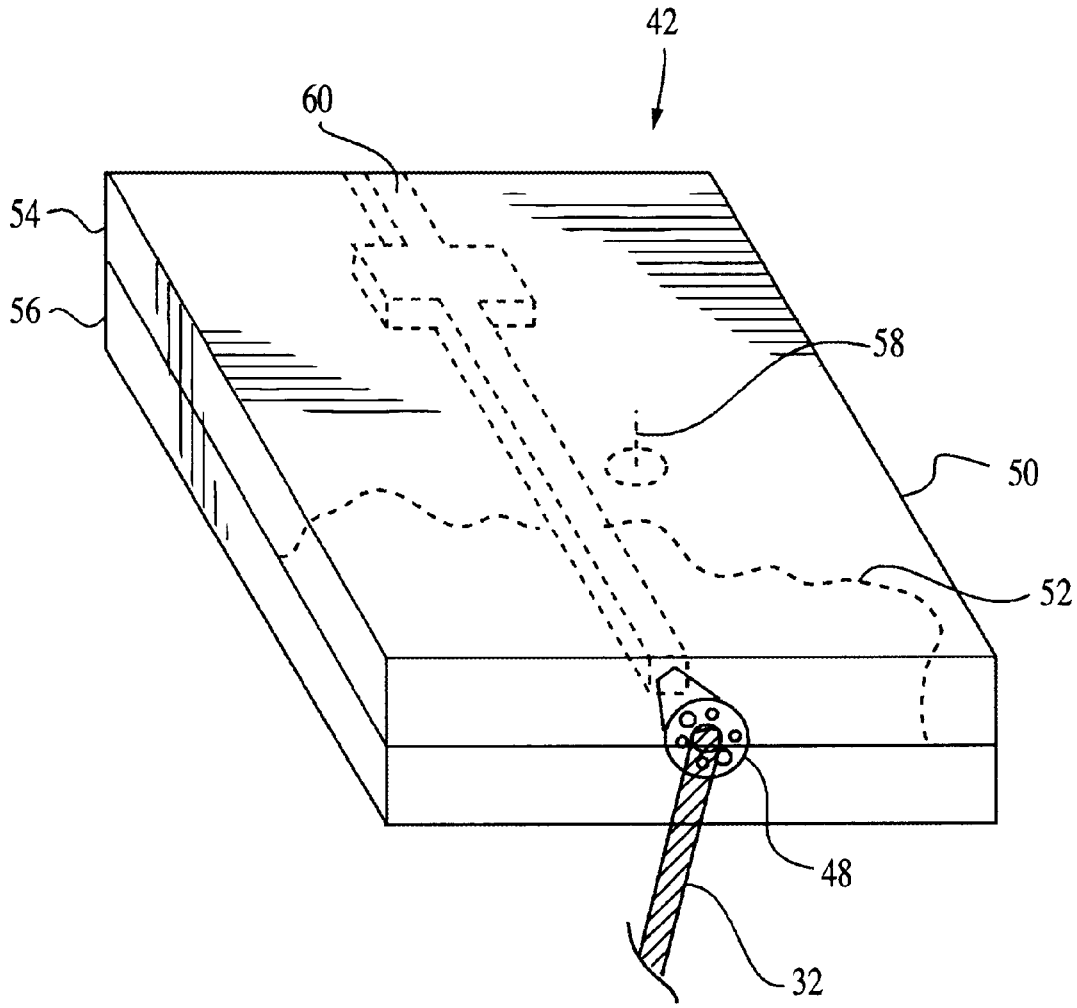
FIG. 3 is a schematic rendering, partially cut-away of an asphalt heater which can be used in the invention.

In practice, however, it is preferred that the invention be used with an asphalt heater as illustrated in FIGS. 3, 4, 5, and 6. Referring now to FIG. 3, the asphalt heater 42 includes a housing 50 which is divided horizontally into an upper chamber 54 and a lower chamber 56 by a sheet or board of gas-permeable refractory material 52. The lower end of the lower chamber 56 is open to the environment.

A combustible fuel-air mixture is introduced into the upper chamber of the asphalt heater by way of fuel line 32. Combustible fuel, stored in fuel tank 30 (see FIG. 1), is passed through a venturi 48 under pressure, whereby the air and fuel are turbulently mixed to yield a combustible fuel-air mixture. As shown in FIG. 3, the venturi enters the upper chamber through a side wall of the housing 50. The venturi can also be positioned to enter the upper chamber from the top wall of the housing. The fuel-air mixture then passes into a manifold 60 which is disposed within the upper chamber of the asphalt heater. Optionally, as the fuel-air mixture enters the manifold, a small amount of the mixture may be directed to a pilot light 62 via pilot light fuel line 32*a* (see FIG. 4, described below). In the absence of the fuel line 32*a*, the mixture is simply introduced into the upper chamber via line 32. The main portion of the fuel-air mixture exits the manifold at outlets 61 and fills the upper chamber 54 of the asphalt heater.

It is preferred that the pressure within the upper chamber of the asphalt heater remain relatively low, on the order of 2.54 to 12.7 kgs per $m^2$. That allows the device to be operated safely without the need for complicated gas regulator equipment. At that pressure, the combustible fuel-air mixture can pass through the refractory material 52 and into the lower chamber of the heater.

Figure 4:
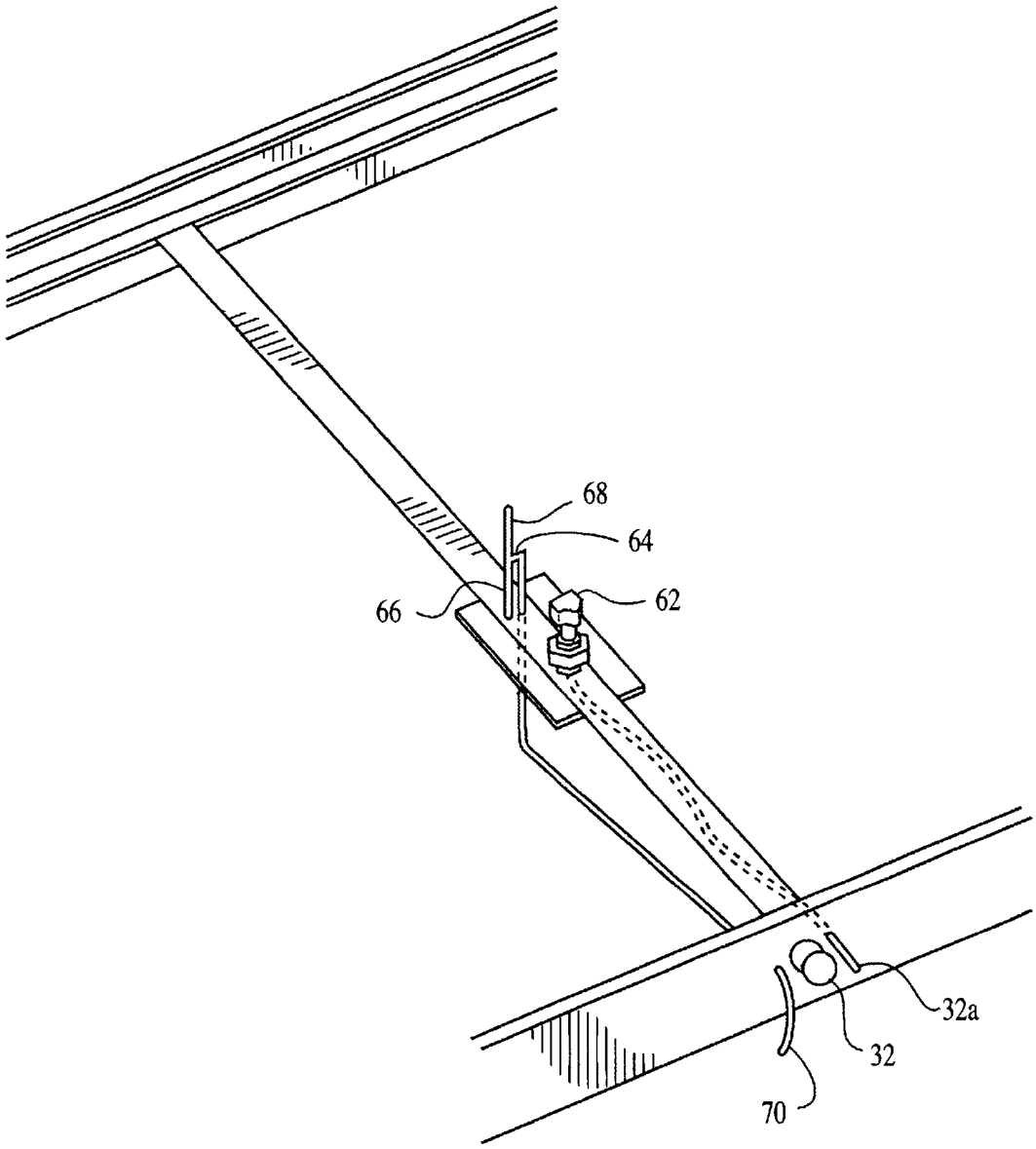
FIG. 4 is a bottom-perspective cutaway rendering of the asphalt heater shown in FIG. 3, and illustrating an ignition sub-assembly. Shown are the main gas supply, pilot light gas supply, flame-sensor, and ignition.

Referring now to FIG. 4, which is an inverted view of the asphalt heater (i.e. through the open lower end of the lower chamber 56), below the refractory material 52 is positioned an ignition sub-assembly which includes a pilot light 62, an igniter having a positive lead 64 and a ground lead 66, an electrical connector 70 to drive the igniter and a flame sensor/thermostat 68. (The refractory 52 is not depicted for purpose of clarity in FIG. 4.) The positive lead 64 of the igniter is connected to a suitable electrical source, such as the battery 22. By supplying sufficient electrical charge to the lead 64, and arc can be formed across the space separating the positive lead 64 and the ground lead 66. The flame sensor/thermostat 68, which is of conventional and well known design, serves to indicate whether a flame is present within the lower chamber and indicates/regulates the temperature within the lower chamber.

Figure 5:
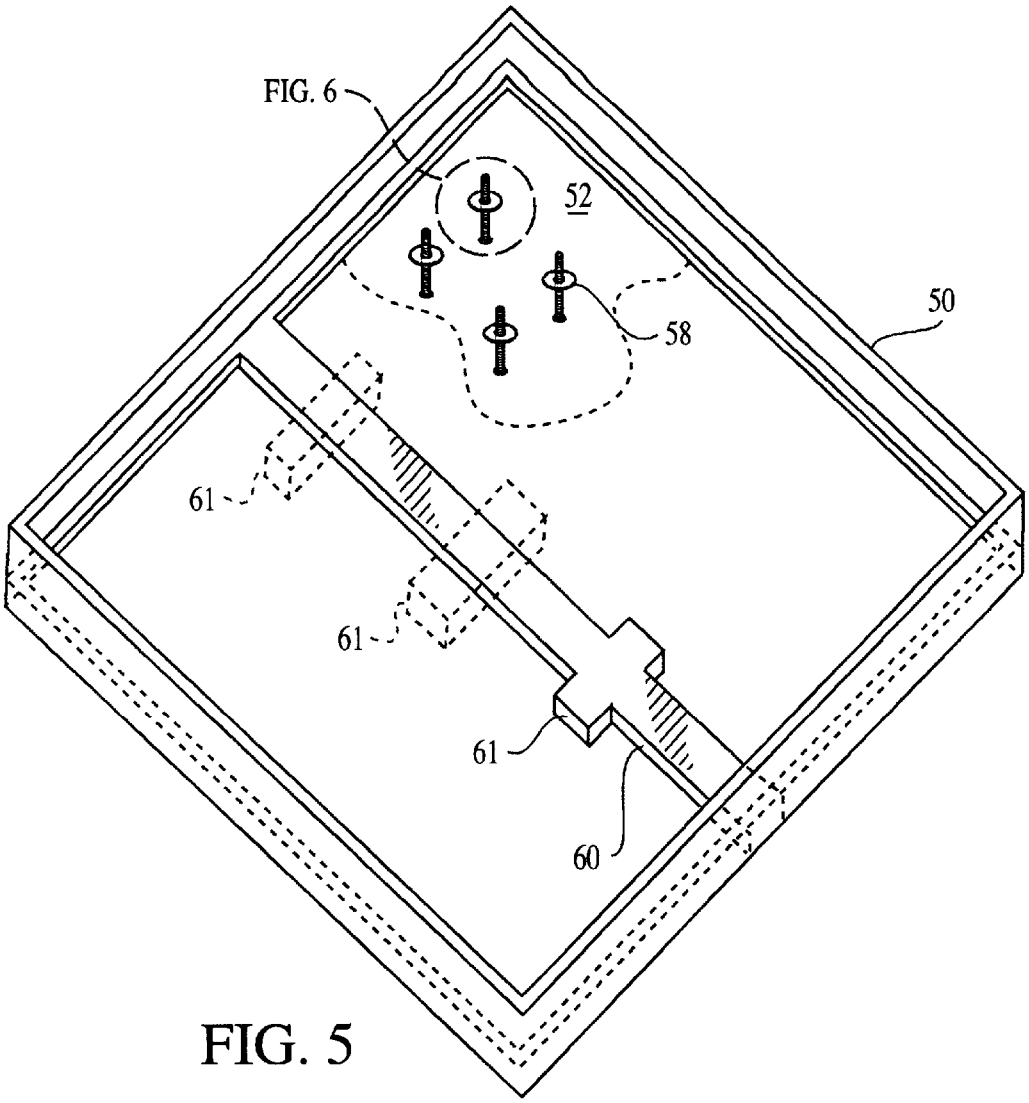
FIG. 5 is a bottom-perspective rendering of the asphalt heater depicted in FIG. 3, with a refractory blanket in place. The ignition sub-assembly has been omitted for clarity. The measurements are illustrative only and do not limit the size or proportion of the invention in any fashion.
Figure 6:
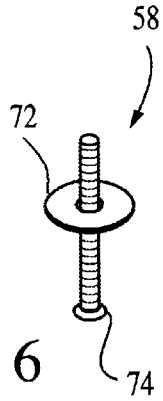
FIG. 6 is a perspective rendering of a fastener depicted in FIG. 5.

FIG. 5 is a depiction of the asphalt heater from the same direction as in FIG. 4, with the ignition sub-assembly removed and the refractory material partially removed. This view depicts the preferred means by which the refractory material 52 is suspended within the housing. Descending from the top side of the housing are a plurality of fasteners 58, one of which is depicted in isolation in FIG. 6. Each fastener comprises a bolt 74 and a washer 72 attached to the bolt. The bolts extend from the top of the housing through the refractory material and protrude from the lower surface of the refractory material. The washers 72 are then attached to the bolts from the direction of the lower, open end of the lower chamber of the housing. In this fashion, the refractory material 52 rests upon a plurality of washers which are anchored to the top surface of the housing by way of the bolts 74.

The entire asphalt heating apparatus is attached to the trailer 10 be way of any suitable means for attachment, such as mounting brackets 46. (See FIG. 1.) Also depicted in FIG. 1 are winches 44 for raising and lowering one or more asphalt heater panels. The winches may be manual or powered. Also shown in FIG. 1 are connectors 76 which can be used to connect any number of asphalt heaters in a desired geometric configuration. As depicted in the figure, the connectors are standard hinges. This allows a number of asphalt heating units to be connected to cover a larger, roughly rectangular area of pavement. Or, if a small, inaccessible area is to be heated, the unneeded or interfering heaters can be lifted clear so that the only the area which needs to be heated is exposed to the heat.

The operation of the asphalt heater is generally controlled from a centralized control board 38. The control board is a very simple layout which contains controls for opening and closing the fuel tank 30, adjusting the fuel-to-air ratio, and powering the ignition 64, etc. The control panel may also contain more sophisticated control mechanisms, such as a thermostat controller to regulate the temperature within the lower chamber.

In practice, the heater is operated by first opening the fuel supply tank 30 which supplies fuel under a pressure of about 2.54 to 12.7 kgs per $m^2$ to the fuel supply line 32. The fuel then passes through the venturi 48 where the fuel is mixed with a sufficient amount of air to yield a combustible fuel-air mixture. The mixture then passes into the upper chamber 54 of the housing by way of the manifold 60. When the upper chamber become sufficiently pressurized with the fuel-air mixture, the mixture will begin to diffuse through the refractory material 52 and into the lower chamber 56 of the housing.

At this point, the ignition 64 is activated, which ignites the fuel air mixture in the lower chamber of the housing. After a sufficient amount of time elapses to allow the heater to rise to the desired temperature, the trailer-borne heater is maneuvered, via the self-propelled jack, to the desired location and put to work.

The invention is not confined to the particular construction and arrangement of elements described and illustrated herein, but encompasses all equivalent and modified forms thereof.

What is claimed is:

1. An asphalt heater comprising:

a housing having an upper chamber and a lower chamber;

a gas-permeable refractory material disposed in the housing to define a closed upper chamber and an open-ended lower chamber;

a fuel line for introducing a combustible fuel-air mixture into the upper chamber;

a venturi disposed between the fuel line and the upper chamber; and an igniter disposed in the lower chamber, wherein fuel introduced into the upper chamber diffuses through the gas-permeable refractory material and into the lower chamber, where it is ignited by the igniter.

2. The asphalt heater according to claim 1, wherein pressure of the fuel-air mixture inside the upper chamber is between 2.54 to 12.7 kgs per $m^2$.

3. The asphalt heater according to claim 1, further comprising a manifold disposed within the upper chamber and operationally connected to the venturi.

* * * * *